US008062823B2

(12) United States Patent
Yanus et al.

(10) Patent No.: US 8,062,823 B2
(45) Date of Patent: Nov. 22, 2011

(54) PROCESS FOR PREPARING PHOTOSENSITIVE OUTER LAYER

(75) Inventors: John F. Yanus, Webster, NY (US); Kenny-Tuan Dinh, Webster, NY (US); Jin Wu, Webster, NY (US); Dale S. Renfer, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 800 days.

(21) Appl. No.: 11/900,712

(22) Filed: Sep. 13, 2007

(65) Prior Publication Data

US 2008/0014518 A1 Jan. 17, 2008

Related U.S. Application Data

(63) Continuation-in-part of application No. 10/992,913, filed on Nov. 18, 2004, now abandoned.

(51) Int. Cl.
*G03G 5/12* (2006.01)

(52) U.S. Cl. ..... 430/132; 430/58.7; 430/66

(58) Field of Classification Search ..... 430/58.7, 430/66, 132
See application file for complete search history.

(56) References Cited

U.S. PATENT DOCUMENTS

| | | | | |
|---|---|---|---|---|
| 3,121,006 | A | 2/1964 | Middleton et al. | |
| 4,265,990 | A | 5/1981 | Stolka et al. | |
| 6,096,470 | A * | 8/2000 | Fuller et al. | 430/132 |
| 2006/0105264 | A1 | 5/2006 | Dinh et al. | |

* cited by examiner

*Primary Examiner* — Peter L. Vajda
(74) *Attorney, Agent, or Firm* — Pillsbury Winthrop Shaw Pittman LLP

(57) ABSTRACT

The presently disclosed embodiments are directed to an improved overcoat for an imaging member having a substrate, a charge transport layer, and an overcoat positioned on the charge transport layer, and a process for making the same including combining a resin having a reactive group selected from the group consisting of hydroxyl, carboxylic acid and amide groups, a melamine formaldehyde crosslinking agent, a formaldehyde scavenger, an acid catalyst, and an alcohol-soluble charge transporting molecule to form an overcoat solution, and subsequently providing the overcoat solution onto the charge transport layer to form an overcoat layer.

8 Claims, 1 Drawing Sheet

PROCESS FOR PREPARING PHOTOSENSITIVE OUTER LAYER

RELATED APPLICATIONS

This application is a continuation-in-part application of utility Publication No. 2006/0105264, filed on Nov. 18, 2004.

BACKGROUND

The presently disclosed embodiments relate generally to layers that are useful in imaging apparatus members and components, for use in electrostatographic, including digital, apparatuses. More particularly, the embodiments pertain to an improved electrostatographic imaging member having a specific overcoat formulation that provides excellent mechanical properties while reducing the amount of formaldehyde released or generated and processes for making the same. In embodiments, the photoreceptor comprises an overcoat having a formaldehyde scavenger therein. In embodiments, the formaldehyde scavenger is selected from the group consisting of ethylene urea, dimethylol ethylene urea and mixtures thereof.

Electrophotographic imaging members, e.g., photoreceptors, photoconductors, imaging members, and the like, typically include a photoconductive layer formed on an electrically conductive substrate. The photoconductive layer is an insulator in the substantial absence of light so that electric charges are retained on its surface. Upon exposure to light, charge is generated by the photoactive pigment, and under applied field charge moves through the photoreceptor and the charge is dissipated.

In electrophotography, also known as xerography, electrophotographic imaging or electrostatographic imaging, the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. Charge generated by the photoactive pigment move under the force of the applied field. The movement of the charge through the photoreceptor selectively dissipates the charge on the illuminated areas of the photoconductive insulating layer while leaving behind an electrostatic latent image. This electrostatic latent image may then be developed to form a visible image by depositing oppositely charged particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

An electrophotographic imaging member may be provided in a number of forms. For example, the imaging member may be a homogeneous layer of a single material such as vitreous selenium or it may be a composite layer containing a photoconductor and another material. In addition, the imaging member may be layered. These layers can be in any order, and sometimes can be combined in a single or mixed layer.

Typical multilayered photoreceptors or imaging members have at least two layers, and may include a substrate, a conductive layer, an optional charge blocking layer, an optional adhesive layer, a photogenerating layer (sometimes referred to as a "charge generation layer," "charge generating layer," or "charge generator layer"), a charge transport layer, an optional overcoating layer and, in some belt embodiments, an anticurl backing layer. In the multilayer configuration, the active layers of the photoreceptor are the charge generation layer (CGL) and the charge transport layer (CTL). Enhancement of charge transport across these layers provides better photoreceptor performance.

The term "photoreceptor" or "photoconductor" is generally used interchangeably with the terms "imaging member." The term "electrostatographic" includes "electrophotographic" and "xerographic." The terms "charge transport molecule" are generally used interchangeably with the terms "hole transport molecule."

One type of composite photoconductive layer used in xerography is illustrated in U.S. Pat. No. 4,265,990, which describes a photosensitive member having at least two electrically operative layers. One layer comprises a photoconductive layer which is capable of photogenerating holes and injecting the photogenerated holes into a contiguous charge transport layer (CTL). Generally, where the two electrically operative layers are supported on a conductive layer, the photoconductive layer is sandwiched between a contiguous CTL and the supporting conductive layer. Alternatively, the CTL may be sandwiched between the supporting electrode and a photoconductive layer. Photosensitive members having at least two electrically operative layers, as disclosed above, provide excellent electrostatic latent images when charged in the dark with a uniform negative electrostatic charge, exposed to a light image and thereafter developed with finely divided electroscopic marking particles. The resulting toner image is usually transferred to a suitable receiving member such as paper or to an intermediate transfer member which thereafter transfers the image to a member such as paper.

In the case where the charge-generating layer (CGL) is sandwiched between the CTL and the electrically conducting layer, the outer surface of the CTL is charged negatively and the conductive layer is charged positively. The CGL then should be capable of generating electron hole pair when exposed image wise and inject only the holes through the CTL. In the alternate case when the CTL is sandwiched between the CGL and the conductive layer, the outer surface of CGL layer is charged positively while conductive layer is charged negatively and the holes are injected through from the CGL to the CTL. The CTL should be able to transport the holes with as little trapping of charge as possible. In flexible web like photoreceptor the charge conductive layer may be a thin coating of metal on a thin layer of thermoplastic resin.

In a typical machine design, a drum photoreceptor is coated with one or more coatings applied by well known techniques such as dip coating or spray coating. Dip coating of drums usually involves immersing of a cylindrical drum while the axis of the drum is maintained in a vertical alignment during the entire coating and subsequent drying operation. Because of the vertical alignment of the drum axis during the coating operation, the applied coatings tend to be thicker at the lower end of the drum relative to the upper end of the drum due to the influence of gravity on the flow of the coating material. Coatings applied by spray coating can also be uneven, e.g., orange peel effect. Coatings that have an uneven thickness do not have uniform electrical properties at different locations of the coating. Under a normal machine imaging function condition, the photoreceptor is subjected to physical/mechanical/electrical/chemical species actions against the layers due to machine subsystems interactions. These machine subsystems interactions contribute to surface contamination, scratching, abrasion and rapid surface wear problems.

As electrophotography advances, the complex, highly sophisticated duplicating systems need to operate at very high speeds which places stringent requirements on imaging members and may reduce imaging member longevity. Thus, there is a continued need for achieving increased life span of photoconductive imaging members while maintaining good mechanical properties. In addition, although present photoreceptors provide excellent mechanical properties such as abrasion resistance, crack resistance and wear resistance, known crosslinking agents contain and/or generate formaldehyde in small quantities. Small quantities of formaldehyde are objectionable in the manufacturing plant due to the necessity of protective gear to avoid exposure, for example, exposure limits are less than 0.5 ppm. If transferred/coated in the open atmosphere of the pilot plant, levels can approach 20 ppm. The addition equipment to protect the plant personnel can be expensive. Therefore, it is desired to provide a photoreceptor that reduces and minimizes formaldehyde exposure.

SUMMARY

According to aspects illustrated herein, there is provided a process for preparing an overcoat having reduced formaldehyde release for an imaging member, the imaging member comprising a substrate, a charge generation layer disposed on the substrate, a charge transport layer disposed on the charge generation layer, and an overcoat layer disposed on the charge transport layer, wherein the process comprises: a) adding and reacting a resin comprising a reactive group selected from the group consisting of hydroxyl, carboxylic acid and amide groups, a melamine formaldehyde crosslinking agent, an aldehyde scavenger selected from the group consisting of ethylene urea, dimethylol ethylene urea, and mixtures thereof, an acid catalyst, an alcohol-soluble charge transport molecule to form an overcoat solution; and b) subsequently providing the overcoat solution onto the charge transport layer to form an overcoat layer. A suitable alcoholic solvent is used in forming the overcoat solution.

An embodiment may provide a process for preparing an overcoat having reduced formaldehyde release for an imaging member, the imaging member comprising a substrate, a charge generation layer disposed on the substrate, a charge transport layer disposed on the charge generation layer, and an overcoat layer disposed on the charge transport layer, wherein the process comprises: a) combining a resin, a melamine formaldehyde crosslinking agent, an aldehyde scavenger selected from the group consisting of ethylene urea, dimethylol ethylene urea, and mixtures thereof, an acid catalyst, and N,N'-diphenyl-N,N'-bis(3-hydroxyphenyl)-[1,1'-biphenyl]-4,4'-diamine to form an overcoat solution; and b) subsequently providing the overcoat solution onto the charge transport layer to form an overcoat layer.

Yet another embodiment, there is provided an imaging member comprising a substrate, a charge generation layer disposed on the substrate, a charge transport layer disposed on the charge generation layer, and an overcoat layer disposed on the charge transport layer, wherein the overcoat layer is prepared by the above processes.

BRIEF DESCRIPTION OF THE DRAWINGS

For a better understanding, reference may be had to the accompanying figures.

DETAILED DESCRIPTION

Figure 1:
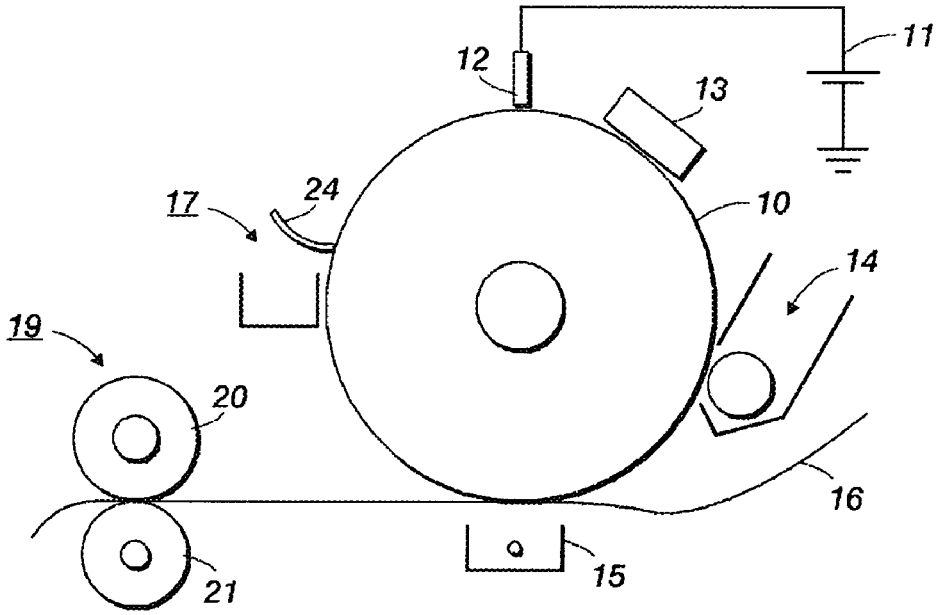
FIG. 1 is a schematic nonstructural view showing an image forming apparatus according to the present embodiments.

In the following description, reference is made to the accompanying drawings, which form a part hereof and which illustrate several embodiments. It is understood that other embodiments may be utilized and structural and operational changes may be made without departure from the scope of the present disclosure. The same reference numerals are used to identify the same structure in different figures unless specified otherwise. The structures in the figures are not drawn according to their relative proportions and the drawings should not be interpreted as limiting the disclosure in size, relative size, or location.

The presently disclosed embodiments are directed generally to an improved electrostatographic imaging member having a specific overcoat formulation that provides excellent mechanical properties while reducing the amount of formaldehyde released or generated, and processes for making the overcoat layer. The overcoat layer provides abrasion resistance, crack resistance and wear resistance.

There are processes for making a specific overcoat formulation that provides improved scratch resistance. As disclosed in U.S. Publication No. 2006/0105264, these processes include combining in solution a resin comprising a reactive group selected from the group consisting of hydroxyl, carboxylic acid and amide groups, a melamine formaldehyde crosslinking agent, an acid catalyst, and an alcohol-soluble small molecule in order to prepare an overcoat layer for a photosensitive member. In embodiments, the resin forms a polyamide. By heating the photosensitive member, the outer coating forms a crosslinked network on the outer surface as an overcoat layer.

However, the cross-linking agent generates formaldehyde in small quantities. Due to the toxicity of formaldehyde, small quantities are to be avoided otherwise protective gear for personnel is needed, and such additional equipment is expensive. It has been discovered that, by incorporating a formaldehyde scavenger into the overcoat formulation, the resulting formaldehyde exposure is significantly reduced. The present embodiments thus provide an overcoat layer that includes a formaldehyde scavenger such as ethylene urea and dimethylol ethylene urea, and processes for making the overcoat layer. In embodiments, the aldehyde scavenger comprises from about 0.1 percent to about 10 percent by weight of total solids.

Referring to FIG. 1, in a typical electrostatographic reproducing apparatus, a light image of an original to be copied is recorded in the form of an electrostatic latent image upon a photosensitive member and the latent image is subsequently rendered visible by the application of electroscopic thermoplastic resin particles which are commonly referred to as toner. Specifically, photoreceptor 10 is charged on its surface by means of an electrical charger 12 to which a voltage has been supplied from power supply 11. The photoreceptor is then imagewise exposed to light from an optical system or an image input apparatus 13, such as a laser and light emitting diode, to form an electrostatic latent image thereon. Generally, the electrostatic latent image is developed by bringing a developer mixture from developer station 14 into contact therewith. Development can be effected by use of a magnetic brush, powder cloud, or other known development process.

After the toner particles have been deposited on the photoconductive surface, in image configuration, they are transferred to a copy sheet 16 by transfer means 15, which can be pressure transfer or electrostatic transfer. In embodiments, the developed image can be transferred to an intermediate transfer member and subsequently transferred to a copy sheet.

After the transfer of the developed image is completed, copy sheet 16 advances to fusing station 19, depicted in FIG. 1 as fusing and pressure rolls, wherein the developed image is fused to copy sheet 16 by passing copy sheet 16 between the fusing member 20 and pressure member 21, thereby forming a permanent image. Fusing may be accomplished by other fusing members such as a fusing belt in pressure contact with a pressure roller, fusing roller in contact with a pressure belt, or other like systems. Photoreceptor 10, subsequent to transfer, advances to cleaning station 17, wherein any toner left on photoreceptor 10 is cleaned therefrom by use of a blade 24 (as shown in FIG. 1), brush, or other cleaning apparatus.

Figure 2:
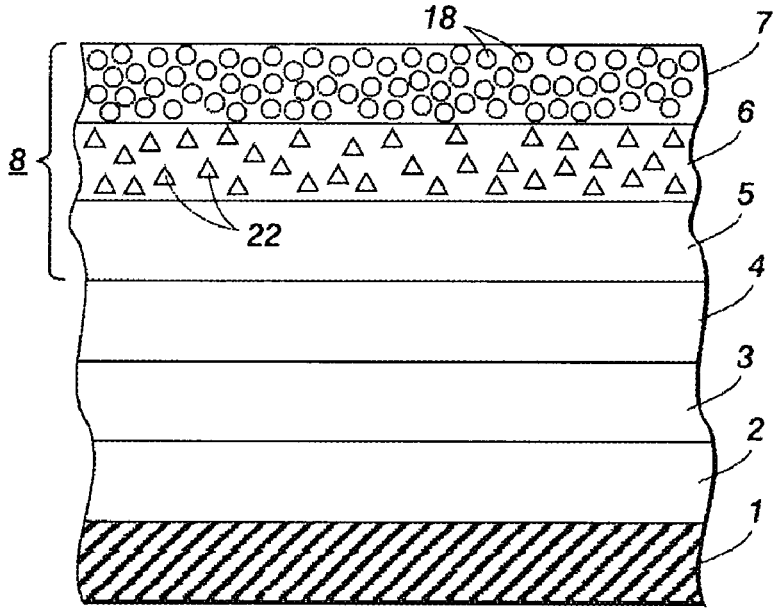
FIG. 2 is a cross-sectional view of an imaging member showing various layers according to the present embodiments.

Electrophotographic imaging members are well known in the art. Electrophotographic imaging members may be prepared by any suitable technique. Referring to FIG. 2, typically, a flexible or rigid substrate 1 is provided with an electrically conductive surface or coating 2. The substrate may be opaque or substantially transparent and may comprise any suitable material having the required mechanical properties. Accordingly, the substrate may comprise a layer of an electrically non-conductive or conductive material such as an inorganic or an organic composition. As electrically non-conducting materials, there may be employed various resins known for this purpose including polyesters, polycarbonates, polyamides, polyurethanes, and the like which are flexible as thin webs. An electrically conducting substrate may be any metal, for example, aluminum, nickel, steel, copper, and the like or a polymeric material, as described above, filled with an electrically conducting substance, such as carbon, metallic powder, and the like or an organic electrically conducting material. The electrically insulating or conductive substrate may be in the form of an endless flexible belt, a web, a rigid cylinder, a sheet and the like. The thickness of the substrate layer depends on numerous factors, including strength desired and economical considerations. Thus, for a drum, this layer may be of substantial thickness of, for example, up to many centimeters or of a minimum thickness of less than a millimeter. Similarly, a flexible belt may be of substantial thickness, for example, about 250 micrometers, or of minimum thickness less than 50 micrometers, provided there are no adverse effects on the final electrophotographic device.

In embodiments where the substrate layer is not conductive, the surface thereof may be rendered electrically conductive by an electrically conductive coating 2. The conductive coating may vary in thickness over substantially wide ranges depending upon the optical transparency, degree of flexibility desired, and economic factors. Accordingly, for a flexible photoresponsive imaging device, the thickness of the conductive coating may be between about 20 angstroms to about 750 angstroms, or from about 100 angstroms to about 200 angstroms for an optimum combination of electrical conductivity, flexibility and light transmission. The flexible conductive coating may be an electrically conductive metal layer formed, for example, on the substrate by any suitable coating technique, such as a vacuum depositing technique or electrodeposition. Typical metals include aluminum, zirconium, niobium, tantalum, vanadium and hafnium, titanium, nickel, stainless steel, chromium, tungsten, molybdenum, and the like.

An optional hole blocking layer 3 may be applied to the substrate 1 or coating. Any suitable and conventional blocking layer capable of forming an electronic barrier to holes between the adjacent photoconductive layer 8 (or electrophotographic imaging layer 8) and the underlying conductive surface 2 of substrate 1 may be used.

An optional adhesive layer 4 may be applied to the hole-blocking layer 3. Any suitable adhesive layer well known in the art may be used. Typical adhesive layer materials include, for example, polyesters, polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the hole blocking layer include spraying, dip coating, roll coating, wire wound rod coating, gravure coating, Bird applicator coating, and the like. Drying of the deposited coating may be effected by any suitable conventional technique such as oven drying, infrared radiation drying, air drying and the like.

At least one electrophotographic imaging layer 8 is formed on the adhesive layer 4, blocking layer 3 or substrate 1. The electrophotographic imaging layer 8 may be a single layer (7 in FIG. 2) that performs both charge-generating and charge transport functions as is well known in the art, or it may comprise multiple layers such as a charge generator layer 5 and charge transport layer 6.

The charge generating layer 5 can be applied to the electrically conductive surface, or on other surfaces in between the substrate 1 and charge generating layer 5. A charge blocking layer or hole-blocking layer 3 may optionally be applied to the electrically conductive surface prior to the application of a charge generating layer 5. If desired, an adhesive layer 4 may be used between the charge blocking or hole-blocking layer 3 and the charge generating layer 5. Usually, the charge generation layer 5 is applied onto the blocking layer 3 and a charge transport layer 6, is formed on the charge generation layer 5. This structure may have the charge generation layer 5 on top of or below the charge transport layer 6.

Charge generator layers may comprise amorphous films of selenium and alloys of selenium and arsenic, tellurium, germanium and the like, hydrogenated amorphous silicon and compounds of silicon and germanium, carbon, oxygen, nitrogen and the like fabricated by vacuum evaporation or deposition. The charge-generator layers may also comprise inorganic pigments of crystalline selenium and its alloys; Group II-VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos; and the like dispersed in a film forming polymeric binder and fabricated by solvent coating techniques.

Phthalocyanines have been employed as photogenerating materials for use in laser printers using infrared exposure systems. Infrared sensitivity is required for photoreceptors exposed to low-cost semiconductor laser diode light exposure devices. The absorption spectrum and photosensitivity of the phthalocyanines depend on the central metal atom of the compound. Many metal phthalocyanines have been reported and include, oxyvanadium phthalocyanine, chloroaluminum phthalocyanine, copper phthalocyanine, oxytitanium phthalocyanine, chlorogallium phthalocyanine, hydroxygallium phthalocyanine magnesium phthalocyanine and metal-free phthalocyanine. The phthalocyanines exist in many crystal forms, and have a strong influence on photogeneration.

Any suitable polymeric film forming binder material may be employed as the matrix in the charge-generating (photogenerating) binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrenebutadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

The photogenerating composition or pigment is present in the resinous binder composition in various amounts. Generally, however, from about 5 percent by volume to about 90 percent by volume of the photogenerating pigment is dispersed in about 10 percent by volume to about 95 percent by volume of the resinous binder, or from about 20 percent by volume to about 30 percent by volume of the photogenerating pigment is dispersed in about 70 percent by volume to about 80 percent by volume of the resinous binder composition. In one embodiment, about 8 percent by volume of the photogenerating pigment is dispersed in about 92 percent by volume of the resinous binder composition. The photogenerator layers can also fabricated by vacuum sublimation in which case there is no binder.

Any suitable and conventional technique may be used to mix and thereafter apply the photogenerating layer coating mixture. Typical application techniques include spraying, dip coating, roll coating, wire wound rod coating, vacuum sublimation, and the like. For some applications, the generator layer may be fabricated in a dot or line pattern. Removing of the solvent of a solvent coated layer may be effected by any suitable conventional technique such as oven drying, infrared radiation drying, air drying and the like.

The charge transport layer 6 may comprise a charge transporting small molecule 22 dissolved or molecularly dispersed in a film forming electrically inert polymer such as a polycarbonate. The term "dissolved" as employed herein is defined herein as forming a solution in which the small molecule is dissolved in the polymer to form a homogeneous phase. The expression "molecularly dispersed" is used herein is defined as a charge transporting small molecule dispersed in the polymer, the small molecules being dispersed in the polymer on a molecular scale. Any suitable charge transporting or electrically active small molecule may be employed in the charge transport layer of this invention. The expression charge transporting "small molecule" is defined herein as a monomer that allows the free charge photogenerated in the transport layer to be transported across the transport layer. Typical charge transporting small molecules include, for example, pyrazolines such as 1-phenyl-3-(4'-diethylamino styryl)-5-(4"-diethylamino phenyl)pyrazoline, diamines such as N,N'-diphenyl-N,N'-bis(3-methylphenyl)-(1,1'-biphenyl)-4,4'-diamine, hydrazones such as N-phenyl-N-methyl-3-(9-ethyl)carbazyl hydrazone and 4-diethylamino benzaldehyde-1,2-diphenyl hydrazone, and oxadiazoles such as 2,5-bis(4-N,N'-diethylaminophenyl)-1,2,4-oxadiazole, stilbenes and the like. As indicated above, suitable electrically active small molecule charge transporting compounds are dissolved or molecularly dispersed in electrically inactive polymeric film forming materials. A small molecule charge transporting compound that permits injection of holes from the pigment into the charge generating layer with high efficiency and transports them across the charge transport layer with very short transit times is N,N'-diphenyl-N,N'-bis(3-methylphenyl)-(1,1'-biphenyl)-4,4'-diamine (TPD).

If desired, the charge transport material in the charge transport layer may comprise a polymeric charge transport material or a combination of a small molecule charge transport material and a polymeric charge transport material.

Any suitable electrically inactive resin binder insoluble in the alcohol solvent may be employed in the charge transport layer of this invention. Typical inactive resin binders include polycarbonate resin (such as MAKROLON), polyester, polyarylate, polyacrylate, polyether, polysulfone, and the like. Molecular weights can vary, for example, from about 20,000 to about 150,000. Examples of binders include polycarbonates such as poly(4,4'-isopropylidene-diphenylene)carbonate (also referred to as bisphenol-A-polycarbonate, poly(4,4'-cyclohexylidinediphenylene)carbonate (referred to as bisphenol-Z polycarbonate), poly(4,4'-isopropylidene-3,3'-dimethyl-diphenyl)carbonate (also referred to as bisphenol-C-polycarbonate) and the like. Any suitable charge transporting polymer may also be used in the charge transporting layer of this invention. The charge transporting polymer should be insoluble in the alcohol solvent employed to apply the overcoat layer of this invention. These electrically active charge transporting polymeric materials should be capable of supporting the injection of photogenerated holes from the charge generation material and be capable of allowing the transport of these holes there through.

Any suitable and conventional technique may be used to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infrared radiation drying, air drying and the like.

Generally, the thickness of the charge transport layer is between about 10 and about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layers can be maintained from about 2:1 to 200:1 and in some instances as great as 400:1. The charge transport layer, is substantially non-absorbing to visible light or radiation in the region of intended use but is electrically "active" in that it allows the injection of photogenerated holes from the photoconductive layer, i.e., charge generation layer, and allows these holes to be transported through itself to selectively discharge a surface charge on the surface of the active layer.

In embodiments, an overcoat layer 7 is coated on the charge-transporting layer. In embodiments, the overcoat layer is prepared by combining in solution a resin, melamine formaldehyde crosslinking agent, a formaldehyde scavenger, an acid catalyst, and a small molecule. In embodiments, the resin comprises a reactive group selected from the group consisting of hydroxy, carboxylic acid and amide groups. The term "resin" means a monomer or low molecular weight polymer that contains reactive groups that form a crosslinked polymer network when reacted with a crosslinking agent. Low molecular weight polymers are the result of reacting monomers to form very short polymers containing from about 5 to about 100 units. These products exhibit poor mechanical properties. Increasing chain length to from about 500 to about 1000 units is necessary to discover mature polymer properties. Crosslinked systems are different in that chain length cannot be determined due to insolubility of the system. Polymer chains are two dimensions, while crosslinking creates three dimensional networks. In embodiments, the resins are monomers or low molecular weight polymer containing hydroxyl, carboxylic acid, and/or amide groups.

The overcoat layer includes in embodiments a crosslinking coating mixture of a polyol and an acrylated polyol film forming resin, and where, for example, the crosslinkable polymer can be electrically insulating, semiconductive or conductive, and can be charge transporting or free of charge transporting characteristics. Examples of polyols include a highly branched polyol where highly branched refers, for example, to a resin synthesized using a sufficient amount of trifunctional alcohols, such as triols or a polyfunctional polyol with a high hydroxyl number to form a polymer comprising a number of branches off of the main polymer chain. The polyol can possess a hydroxyl number of, for example, from about 10 to about 10,000 and can include ether groups, or can be free of ether groups. Suitable acrylated polyols can be, for example, generated from the reaction products of propylene oxide modified with ethylene oxide, glycols, triglycerol and the like, and wherein the acrylated polyols can be represented by the following formula:

$$[R_t—CH_2]_t—[—CH_2—R_a—CH_2]_p—[—CO—R_b—CO—]_n—[—CH_2—R_c—CH_2]_p—[—CO—R_d—CO—]_q$$

wherein $R_t$ represents $CH_2CR_1CO_2$—, $R_1$ is alkyl with, for example, from 1 to about 25 carbon atoms, and more specifically, from 1 to about 12 carbon atoms, such as methyl, ethyl, propyl, butyl, hexyl, heptyl, and the like; $R_a$ and $R_c$ independently represent linear alkyl groups, alkoxy groups, branched alkyl or branched alkoxy groups with alkyl and alkoxy groups possessing, for example, from 1 to about 20 carbon atoms; $R_b$ and $R_d$ independently represent alkyl or alkoxy groups having, for example, from 1 to about 20 carbon atoms; and m, n, p, and q represent mole fractions of from 0 to 1, such that n+m+p+q is equal to 1. Examples of commercial acrylated polyols are JONCRYL™ polymers, available from Johnson Polymers Inc. and POLYCHEM™ polymers such as 7558-B-60, available from OPC Polymers Inc.

The overcoat layer includes in embodiments a crosslinking agent and catalyst where the crosslinking agent can be, for example, a melamine crosslinking agent or accelerator. Incorporation of a crosslinking agent can provide reaction sites to interact with the acrylated polyol to provide a branched, crosslinked structure. When so incorporated, any suitable crosslinking agent or accelerator can be used, including, for example, trioxane, melamine compounds, and mixtures thereof.

Commercially available examples of a resin having reactive groups selected from the group consisting of hydroxy, carboxylic acid and amide groups, include hydroxyl containing resins such as JONCRYL 510, JONCRYL 580, JONCRYL 587, and the like, available from Johnson Polymer, DESMOPHEN, and the like from Bayer Chemical, POLYCHEM™ polymers such as 7558-B-60, available from OPC Polymers Inc. and polyamides such as LUCKAMIDE 5003, available from Dai Nippon Ink.

In embodiments, the resin comprises from about 10 to about 50 percent solids, or from about 20 to about 40 percent solids, or about 32 percent solids. In embodiments, the resin is diluted in a solvent such as an alcohol selected from the group consisting of 1-methoxy-2-propanol, 2-butanol, 2-propanol, or the like. The solvent is added in an amount of from about 50 to about 95 percent of the solution weight, or from about 65 to about 90 percent of the solution weight, or from about 65 to about 80 percent of the solution weight.

Examples of melamine formaldehyde crosslinking agents include highly methylated/butylated melamine resins, such as those commercially available from Cytec Industries, such as CYMEL 303, CYMEL 104, CYMEL MM-100, and the like. These melamine formaldehyde crosslinking agents exhibit a high degree of alkylation. In embodiments, the crosslinking agent has from about 5 to about 40 percent solids by weight.

The formaldehyde scavenger include ethylene urea and dimethylol ethylene urea. The addition of the scavenger in the overcoat layer reduces formaldehyde release. As overcoat layers using melamine formaldehyde crosslinking agents have been shown to generate over 20 ppm of formaldehyde exposure in pilot plant trials, this is of concern since safety levels are limited to 0.3 ppm or lower. The scavenger molecule is doped into the coating solution at low concentration, for example less than about 10%, with an acid catalyst to accelerate the crosslinking.

The reaction of these highly functionalized crosslinking agents with resins can be catalyzed by the presence of a strong acid catalyst. Examples of acid catalysts include p-toluene sulfonic acid, and include commercially available acid catalysts from Cycat such as CYCAT 600, CYCAT 4040, and the like. In embodiments, the catalyst is added and reacted in an amount of from about 0.1 to about 5 percent, or from about 0.3 to about 3, or from about 0.4 to about 1 percent by weight of total solids.

In embodiments, the charge transporting small molecule is a crosslinkable alcohol-soluble small molecule wherein the overcoating charge transport component is:

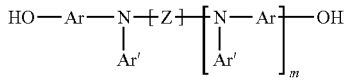

wherein m is zero or 1; Z is selected from the group consisting of at least one of:

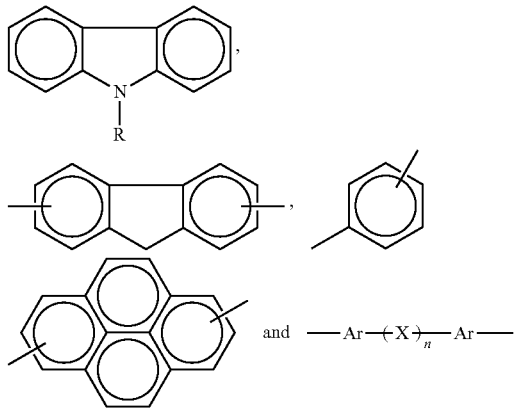

wherein n is 0 or 1; Ar is selected from the group consisting of at least one of:

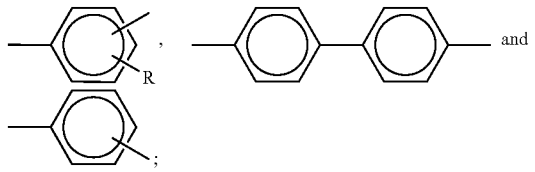

wherein R is selected from the group consisting of at least one of —$CH_3$, —$C_2H_5$, —$C_3H_7$, and $C_4H_9$; Ar' is selected from the group consisting of at least one of:

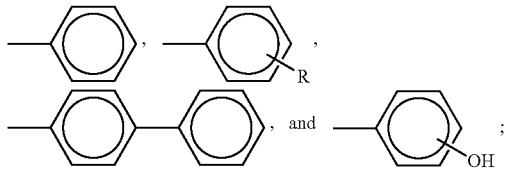

and X is selected from the group consisting of at least one of:

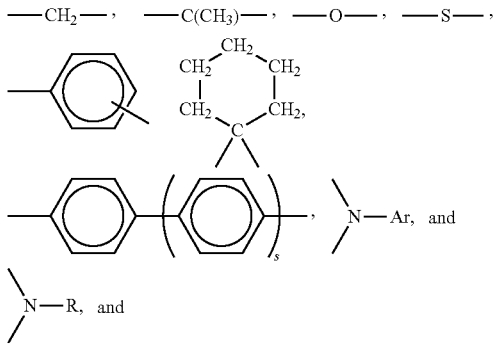

wherein S is zero, 1, or 2. Examples include alcohol soluble charge transport materials such as N,N'-diphenyl-N,N'-bis(3-hydroxyphenyl)-[1,1'-biphenyl]-4,4'-diamine [DHTPD] represented by:

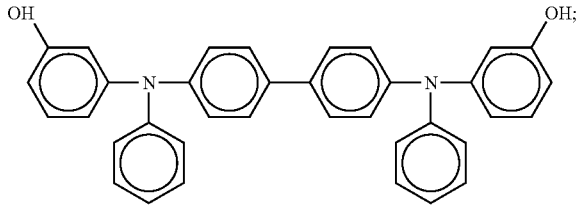

or dihydroxyaryl terphenylamines as represented by:

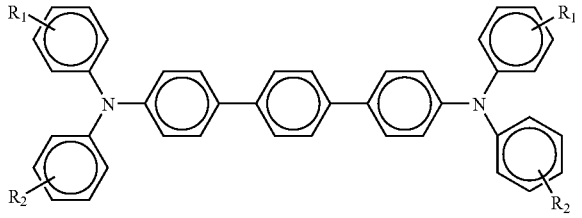

wherein each $R_1$ and $R_2$ is independently selected from the group consisting of at least one of —H, —OH, —$C_nH_{2n+1}$ where n is from 1 to about 12; aralkyl, and aryl groups, the aralkyl and aryl groups having, for example, from about 6 to about 36 carbon atoms.

The overcoat layer includes in embodiments a crosslinking agent and catalyst where the crosslinking agent can be, for example, a melamine crosslinking agent or accelerator. Incorporation of a crosslinking agent can provide reaction sites to interact with the acrylated polyol to provide a branched, crosslinked structure. When so incorporated, any suitable crosslinking agent or accelerator can be used, including, for example, trioxane, melamine compounds, and mixtures thereof. When melamine compounds are selected, they can be functionalized, examples of which are melamine formaldehyde, methoxymethylated melamine compounds, such as glycouril-formaldehyde and benzoguanamine-formaldehyde, and the like. In embodiments, the crosslinking agent can include a methylated, butylated melamine-formaldehyde. A nonlimiting example of a suitable methoxymethylated melamine compound is CYMEL® 303 (available from Cytec Industries), which is a methoxymethylated melamine compound with the formula $(CH_3OCH_2)_6N_3C_3N_3$ and as represented by

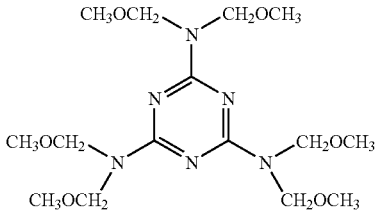

Crosslinking can be accomplished by heating the overcoating components in the presence of a catalyst. Non-limiting examples of catalysts include oxalic acid, maleic acid, carbolic acid, ascorbic acid, malonic acid, succinic acid, tartaric acid, citric acid, p-toluenesulfonic acid, methanesulfonic acid, and the like, and mixtures thereof.

In embodiments, the charge transporting molecule is added and reacted with the resin and the melamine formaldehyde solution in an amount of from about 25 to about 60 percent by weight of total polymer content.

In embodiments, the overcoat layer is a continuous overcoat layer and has a thickness of from about 0.1 to about 10 micrometers, or from about 1 to about 8 microns, or from about 2 to about 5 microns, or about 3 microns.

Any suitable or conventional technique may be used to mix and thereafter apply the overcoat layer coating mixture on the charge transport layer. Typical application techniques include spraying, dip coating, roll coating, wire wound rod coating, and the like. Drying of the deposited coating may be effected by any suitable conventional technique such as oven drying, infrared radiation drying, air drying, and the like. The dried overcoating should transport holes during imaging and should not have too high a free carrier concentration. Free carrier concentration in the overcoat increases the dark decay. In embodiments, the dark decay of the overcoated layer should be about the same as that of the uncoated, control device.

Various exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The example set forth herein below and is illustrative of different compositions and conditions that can be used in practicing the present embodiments. All proportions are by weight unless otherwise indicated. It will be apparent, however, that the embodiments can be practiced with many types of compositions and can have many different uses in accordance with the disclosure above and as pointed out hereinafter.

Example 1

A photoconductor was prepared by providing a 0.02 microns thick titanium layer coated (the coater device) on a biaxially oriented polyethylene naphthalate substrate (KALEDEX™ 2000) having a thickness of 3.5 mils, and applying thereon, with a gravure applicator a solution containing 50 grams of 3-amino-propyltriethoxysilane (blocking or undercoat layer), 41.2 grams of water, 15 grams of acetic acid, 684.8 grams of denatured alcohol, and 200 grams of heptane. The resulting layer was then dried for about 5 minutes at 135° C. in the forced air dryer of the coater. The resulting blocking layer had a dry thickness of 500 Angstroms. An adhesive layer was then prepared by applying a wet coating thereof over the blocking layer, using a gravure applicator or by extrusion, and which adhesive contained 0.2 percent by weight based on the total weight of the solution of copolyester adhesive (ARDEL™ D100 available from Toyota Hsutsu Inc.) in a 60:30:10 volume ratio mixture of tetrahydrofuran/monochlorobenzene/methylene chloride. The adhesive layer was then dried for about 5 minutes at 135° C. in the above forced air dryer of the coater. The resulting adhesive layer had a dry thickness of 200 Angstroms.

A photogenerating layer dispersion was prepared by introducing 0.45 grams of the known polycarbonate LUPILON™ 200 (PCZ-200) or POLYCARBONATE Z™, weight average molecular weight of 20,000, available from Mitsubishi Gas Chemical Corporation, and 50 milliliters of tetrahydrofuran into a 4 ounce glass bottle. To this solution were added 2.4 grams of hydroxygallium phthalocyanine (Type V) and 300 grams of ⅛ inch (3.2 millimeters) diameter stainless steel shot. The resulting mixture was then placed on a ball mill for 8 hours. Subsequently, 2.25 grams of PCZ-200 were dissolved in 46.1 grams of tetrahydrofuran, and added to the hydroxygallium phthalocyanine dispersion. This slurry was then placed on a paint type shaker for 10 minutes. The resulting dispersion was, thereafter, applied to the above adhesive interface with a Bird applicator to form a photogenerating layer having a wet thickness of 0.25 mil. A strip about 10 millimeters wide along one edge of the substrate web bearing the blocking layer and the adhesive layer was deliberately left uncoated by any of the photogenerating layer material to facilitate adequate electrical contact by the ground strip layer that was applied later. The charge generation layer was dried at 135° C. for 5 minutes in a forced air oven to form a dry photogenerating layer having a thickness of 0.4 microns.

The resulting imaging member or photoconductor web was then overcoated with two separate charge transport layers. Specifically, the photogenerating layer was overcoated with a charge transport layer (the bottom layer) in contact with the photogenerating layer. The bottom layer of the charge transport layer was prepared by introducing into an amber glass bottle in a weight ratio of 1:1 N,N'-diphenyl-N,N'-bis(3-methylphenyl)-1,1'-biphenyl-4,4'-diamine, and MAKROLON® 5705, a known polycarbonate resin having a molecular weight average of from about 50,000 to 100,000, commercially available from Farbenfabriken Bayer A.G. The resulting mixture was then dissolved in methylene chloride to form a solution containing 15 percent by weight solids. This solution was applied, using a 2 mil Bird bar, onto the photogenerating layer to form the bottom layer coating that upon drying (120° C. for 1 minute) had a thickness of 14.5 microns. During this coating process, the humidity was equal to or less than 15 percent.

The bottom layer of the charge transport layer (CTL) was then overcoated with a top charge transport layer in a second pass. The charge transport layer solution of the top layer was prepared as described above for the bottom layer. This solution was applied, using a 2 mil Bird bar, on the bottom layer of the charge transport layer to form a coating that upon drying (120° C. for 1 minute) had a thickness of 14.5 microns. During this coating process the humidity was equal to or less than 15 percent. The total CTL thickness was 29 microns.

Example 2

Preparation of Overcoated Photoreceptor 2

A photoconductor was prepared by repeating the process of Example I. An overcoating layer solution was formed by adding 80 grams 1-methoxy-2-propanol, 10 grams of POLYCHEM® 7558-B-60 (an acrylated polyol obtained from OPC Polymers), 4 grams of PPG 2K (a polypropyleneglycol with a weight average molecular weight of 2,000 as obtained from Sigma-Aldrich), 6 grams of CYMEL® 1130 (a methylated, butylated melamine-formaldehyde crosslinking agent obtained from Cytec Industries Inc.), 8 grams of N,N'-diphenyl-N,N'-di[3-hydroxyphenyl]-[1,1'-biphenyl]-4,4'-diamine (DHTPD), 0.3 grams 2-imidazolidone [ethylene urea] and 1.4 grams of 20 percent p-toluenesulfonic acid catalyst/1-methoxy-2-propanol solution into an 8 ounce bottle. The contents were stirred until a complete solution was obtained. The solution was applied onto the photoconductor from Example 1, using a 0.125 mil Bird bar. The resultant overcoating was dried in a forced air oven for 2 minutes at 125° C. to yield a highly, crosslinked, 3 micron thick overcoat, and which overcoat was substantially insoluble in methanol or ethanol.

Example 3

Preparation of Overcoated Photoreceptor 3

An overcoat solution was prepared as in Example 2 except 0.6 grams 2-imidazolidone [ethylene urea] was added. Coating was carried out as in Example 2

Example 4

Preparation of Overcoated Photoreceptor 4

An overcoat solution was prepared as in Example 2 except 0.9 grams 2-imidazolidone [ethylene urea] was added. Coating was carried out as in Example 2

Example 5

Preparation of Overcoated Photoreceptor 5

An overcoat solution was prepared as in Example 2 except 1.2 grams 2-imidazolidone [ethylene urea] was added. Coating was carried out as in Example 2

Example 6

Preparation of Overcoated Photoreceptor 6

An overcoat solution was prepared as in Example 2 except 1.5 grams 2-imidazolidone [ethylene urea] was added. Coating was carried out as in Example 2

Example 7

Preparation of Control Overcoated Photoreceptor 7

An overcoat solution was prepared as in Example 2 except no 2-imidazolidone [ethylene urea] was added. Coating was carried out as in Example 2.

Testing of Photoreceptor

The prepared photoreceptor having the improved overcoat layer was tested for electrical and mechanical properties. The test results, including those regarding photon induced discharge curves (PIDC) and cyclic stability show unchanged properties, as shown in Table 1.

TABLE 1

| | Cycle-up Vexpose (V/kcycle) | Initial Cycle-up (V) | Cycle count | Cycle-up Vresid (V/kcycle) | Cycle count |
|---|---|---|---|---|---|
| Example 2 | 3.89 | 8.866 | 1200 | 4.569 | 1582 |
| Example 3 | 3.857 | 10.036 | 1270 | 4.794 | 1728 |
| Example 4 | 4.198 | 9.988 | 1501 | 4.794 | 1728 |
| Example 5 | 3.901 | 10.615 | 1746 | 4.557 | 1784 |
| Example 6 | 3.701 | 10.302 | 1672 | 4.395 | 1900 |
| Control Example 7 | 4.153 | 9.326 | 1721 | 4.739 | 1474 |

Scratch resistance, crack resistance, running and parking lateral charge migration (LCM) resistance were unchanged, verifying that the desired properties of the overcoat formulation were maintained. High-performance liquid chromatography (HPLC) detection of aldehydes, with tags to enhance sensitivity are outlined in Table 2.

TABLE 2

| | Formaldehyde (μg/g) | Acetone (μg/g) | Acetaldehyde (μg/g) | 2-Imidazoliodine (μg/g) |
|---|---|---|---|---|
| Example 2 | 253 | 388 | 0.8 | 1 |
| Example 3 | 153 | 390 | 0.2 | 2 |
| Example 4 | 69 | 378 | <0.06 | 3 |
| Example 5 | 46 | 376 | 0.8 | 4 |
| Example 6 | 31 | 386 | <0.06 | 5 |
| Control Example 7 | 500 | | | 0 |

All the patents and applications referred to herein are hereby specifically, and totally incorporated herein by reference in their entirety in the instant specification.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A process for preparing an overcoat having reduced formaldehyde release for an imaging member, the imaging member comprising a substrate, a charge generation layer disposed on the substrate, a charge transport layer disposed on the charge generation layer, and an overcoat layer disposed on the charge transport layer, wherein the process comprises:

a) combining a resin containing a reactive group, wherein the reactive group is carboxylic acid, a melamine formaldehyde crosslinking agent, an aldehyde scavenger selected from the group consisting of ethylene urea, dimethylol ethylene urea, and mixtures thereof, an acid catalyst, and N,N'-diphenyl-N,N'-bis(3-hydroxyphenyl)-[1,1'-biphenyl]-4,4'-diamine to form an overcoat solution; and b) subsequently providing the overcoat solution onto the charge transport layer to form an overcoat layer.

2. The process of claim 1, wherein the acid catalyst is p-toulenesulfonic acid.

3. The process of claim 1, wherein the charge transport layer comprises a polycarbonate and N,N'-diphenyl-N,N'-bis(3-methyl-phenyl)-(1,1'-biphenyl)-4,4'-diamine.

4. The process of claim 1, wherein the overcoat solution is provided onto the charge transport layer to a dried thickness of from about 1 micron to about 8 microns.

5. The process of claim 1, wherein the aldehyde scavenger is ethylene urea.

6. The process of claim 1, wherein the aldehyde scavenger is dimethylol ethylene urea.

7. The process of claim 1, wherein the resin is diluted in a solvent prior to adding and reacting in step (a).

8. The process of claim 7, wherein the solvent is selected from the group consisting of 1-methoxy-2-propanol, 2-butanol and 2-propanol.

* * * * *